US010145230B2

(12) United States Patent
DaCunha

(10) Patent No.: US 10,145,230 B2
(45) Date of Patent: Dec. 4, 2018

(54) SYSTEMS AND METHODS FOR REAL-TIME MONITORING OF DOWNHOLE PUMP CONDITIONS

(71) Applicant: Jeffrey J. DaCunha, Flower Mound, TX (US)

(72) Inventor: Jeffrey J. DaCunha, Flower Mound, TX (US)

(73) Assignee: HENRY RESEARCH AND DEVELOPMENT, LLC, Midland, TX (US)

( * ) Notice: Subject to any disclaimer, the term of this patent is extended or adjusted under 35 U.S.C. 154(b) by 297 days.

(21) Appl. No.: 14/827,559

(22) Filed: Aug. 17, 2015

(65) Prior Publication Data

US 2016/0102542 A1 Apr. 14, 2016

Related U.S. Application Data

(60) Provisional application No. 62/062,543, filed on Oct. 10, 2014.

(51) Int. Cl.
*E21B 17/00* (2006.01)
*E21B 47/00* (2012.01)
(Continued)

(52) U.S. Cl.
CPC ..... *E21B 47/0008* (2013.01); *E21B 43/127* (2013.01); *E21B 47/09* (2013.01);
(Continued)

(58) Field of Classification Search
CPC ..... F04B 47/02; F04B 49/065; E21B 43/127
(Continued)

(56) References Cited

U.S. PATENT DOCUMENTS 3,343,409 A 9/1967 Gibbs
3,635,081 A 1/1972 Gibbs
(Continued)

FOREIGN PATENT DOCUMENTS

CN 200982184 11/2007
CN 101285463 10/2008
(Continued)

OTHER PUBLICATIONS

D.R. Doty and Z. Schmidt, An improved model for sucker rod pumping, SPE 10249, SPE Journal (Feb. 1983), 33-41.
(Continued)

*Primary Examiner* — Edward Raymond
(74) *Attorney, Agent, or Firm* — Winstead PC

(57) ABSTRACT

Systems and methods for improved monitoring of downhole pump conditions may provide real-time monitoring, high accuracy, and low noise when monitoring downhole pump conditions. Systems for monitoring pump conditions may be coupled to any suitable sucker rod pump, and may gather desired data from the pump. The desired data may be gathered at several points-in-time during a pump stroke to provide real-time monitoring. A wave equation corresponding to the behavior of the downhole pump may be solved when the desired data is received to provide real-time monitor. In some embodiments, the wave equation may be solved by separating it into static and dynamic solutions. In some embodiments, the dynamic solution of the wave equation may be solved utilizing an integral-based method.

12 Claims, 5 Drawing Sheets

(51) Int. Cl.

| | |
|---|---|
| ***E21B 43/12*** | (2006.01) |
| ***E21B 47/09*** | (2012.01) |
| ***F04B 47/00*** | (2006.01) |
| ***F04B 47/02*** | (2006.01) |
| ***F04B 49/06*** | (2006.01) |

(52) U.S. Cl.
CPC ..... *F04B 47/00* (2013.01); *F04B 47/02* (2013.01); *F04B 49/065* (2013.01)

(58) Field of Classification Search
USPC ..... 702/6, 13, 14, 8, 182–185
See application file for complete search history.

(56) References Cited

U.S. PATENT DOCUMENTS

| | | | | |
|---|---|---|---|---|
| 3,951,209 | A | 4/1976 | Gibbs | |
| 4,015,469 | A | 4/1977 | Womack et al. | |
| 4,034,808 | A | 7/1977 | Patterson | |
| 4,490,094 | A | 12/1984 | Gibbs | |
| 4,583,915 | A | 4/1986 | Montgomery et al. | |
| 4,973,226 | A | 11/1990 | McKee | |
| 5,224,834 | A | 7/1993 | Westerman et al. | |
| 5,237,863 | A | 8/1993 | Dunham | |
| 5,252,031 | A | 10/1993 | Gibbs | |
| 5,941,305 | A | 8/1999 | Thrasher et al. | |
| 6,343,656 | B1 | 2/2002 | Vazquez et al. | |
| 6,857,474 | B2 | 2/2005 | Bramlett et al. | |
| 7,168,924 | B2 | 1/2007 | Beck et al. | |
| 7,212,923 | B2 | 5/2007 | Gibbs et al. | |
| 7,500,390 | B2 | 3/2009 | Mills | |
| 8,036,829 | B2 | 10/2011 | Gibbs et al. | |
| 8,157,537 | B2 | 4/2012 | Zapata et al. | |
| 8,444,393 | B2 | 5/2013 | Beck et al. | |
| 2006/0067834 | A1* | 3/2006 | Boyer | F04B 47/02 417/44.1 |
| 2008/0240930 | A1* | 10/2008 | Palka | E21B 43/127 417/42 |
| 2013/0115107 | A1 | 5/2013 | Pons | |
| 2013/0151216 | A1 | 6/2013 | Palka et al. | |
| 2014/0129037 | A1 | 5/2014 | Peterson | |

FOREIGN PATENT DOCUMENTS

| | | |
|---|---|---|
| WO | 1993002289 | 2/1993 |
| WO | 2014078851 | 5/2014 |

OTHER PUBLICATIONS

T.A. Everitt and J.W. Jennings, An improved finite-differences calculation of downhole dynamometer cards for sucker-rod pumps, SPE 18189, SPE Production Engineering (Feb. 1992), 121-127.

S.G. Gibbs and A.B. Neely, Computer diagnosis of down-hole conditions in sucker rod pumping wells, Journal of Petroleum Technology (Jan. 1966), 91-98; Transactions of the AIME 237.

Benefits of using the SAM Well Manager Brochure, accessed on Sep. 10, 2010. http://www.lufkinautomation.com/downloads/technical_papers/SAM%20benefits.pdf.

Automation Solutions for PCP Variable Speed Drives, Lufkin Well Manager—Variable Speed Drive Brochure, 2013 Lufkin Industries.

Lufkin SAM Well Manager Brochure, 2010 Lufkin Automation.

S.G. Gibbs, Design and diagnosis of deviated rod-pumped wells, Journal of Petroleum Technology (Jul. 1992), 774-781.

J.J. DaCunha and S.G. Gibbs, Modeling a finite-length sucker rod using the semi-infinite wave equation and a proof to Gibbs' conjecture, SPE 108762-PA, SPE Journal 14 No. 1, Mar. 2009, 112-119.

Kun et al., Using the curve moment and the PSO-SVM method to diagnose downhole conditions of a sucker rod pumping unit, Pet.Sci.(2013)10:73-80.

Gibbs, Rod Pumping, Modern Methods of Design, Diagnosis and Surveillance, Chapter 2, 2012 (http://samgibbs.net/wp-content/uploads/2012/01/chapter2.pdf).

Hojjati et al., Modelling of Sucker Rod String, Journal of Canadian Petroleum Technology, vol. 44, Issue 12, 2005 (Preview only—https://www.onepetro.org/journal-paper/PETSOC-05-12-02).

Weatherford, WellPilot® Rod Pump Optimization Controller, 2012 (http://www.weatherford.com/dn/wft192695).

Rod Pumping Overview, 2014 (http://infohost.nmt.edu/~petro/faculty/Kelly/424/ROD%20PM.pdf).

* cited by examiner

SYSTEMS AND METHODS FOR REAL-TIME MONITORING OF DOWNHOLE PUMP CONDITIONS

RELATED APPLICATIONS

This application claims the benefit of U.S. Provisional Patent Application No. 62/062,543, filed on Oct. 10, 2014, which is incorporated herein by reference.

FIELD OF THE INVENTION

The present disclosure relates to systems and methods for real-time monitoring of downhole pump conditions. More particularly, the disclosure relates to real-time monitoring that allows operators to diagnose pump and/or well conditions.

BACKGROUND OF INVENTION

The most commonly implemented artificial lift system in the world is sucker rod pumping. A sucker rod pump (also referred to as a pumpjack or beam pump) is a vertically reciprocating piston pump in an oil well that mechanically lifts liquid out of the well. Sucker rod pumps may employ a pumping unit, a gearbox, and a prime mover at the surface, which drives a downhole pump plunger via a sucker rod string that connects them. A non-limiting illustrative example of sucker rod pump is illustrated in FIGS. 1A-1C. The sucker rod string can be made up of sections of steel rods with different diameters or a combination of steel and fiberglass rods with different diameters. When operating a sucker rod pumping system, being able to determine and diagnose the performance of the downhole pump is critical. A dynamometer measures and records the load and position at the polished rod (the rod that is at the top of the sucker rod string, located at the surface) during the stroke of a pumping unit. This data may be plotted on a graph or display that is often called a surface dynagraph card or surface card. The polished rod (surface) load and position data may be used to compute the load and position of the downhole pump. The plot of the load and position data of the downhole pump is called the pump dynagraph card or downhole card.

Sucker rod pumping systems may monitor the data from the pump dynagraph card and make decisions based on the data. Based on the shape of a resulting plot, pump and/or well conditions may be diagnosed, such as full pump, tubing movement, fluid pound, gas interference, etc. (See FIG. 1D). Some methods for diagnosing performance of a sucker rod pumping system utilize finite differences methodology (e.g. U.S. Pat. Nos. 7,168,924 and 7,500,390). These methods can sometimes produce noisy results with respect to the behavior of the rod string and pump. This noisiness is primarily due to the fact that the derivatives that are estimated numerically through finite differences can amplify the noise at each step, leading to inaccurate results. Additionally, some sucker rod pump control systems are characterized as "real-time," but are not truly real-time systems. In these systems, the data is measured for the duration of the entire pumping cycle (a stroke of the pumping unit) before any calculations are initiated. Once the pumping unit completes the pumping cycle and is beginning the next, such system then begins computing the downhole card and generating the output.

Improved systems and methods for monitoring of downhole pump conditions are discussed herein. These improved systems and methods provide real-time monitoring, high accuracy, and low noise when monitoring downhole pump conditions.

SUMMARY OF INVENTION

In one embodiment, systems and methods for improved monitoring of downhole pump conditions may provide real-time monitoring, high accuracy, and low noise when monitoring downhole pump conditions. Systems for monitoring pump conditions may be coupled to any suitable sucker rod pump and may gather desired data from the pumping unit system. The desired data may be gathered at several points-in-time during a pump stroke to provide real-time monitoring. A wave equation corresponding to the behavior of the downhole pump may be solved when the desired data is received in order to provide real-time monitoring. In some embodiments, the wave equation may be solved by separating it into static and dynamic solutions. In some embodiments, the dynamic solution of the wave equation may be solved utilizing an integral-based method.

The foregoing has outlined rather broadly various features of the present disclosure in order that the detailed description that follows may be better understood. Additional features and advantages of the disclosure will be described hereinafter.

BRIEF DESCRIPTION OF THE DRAWINGS

For a more complete understanding of the present disclosure, and the advantages thereof, reference is now made to the following descriptions to be considered in conjunction with the accompanying drawings describing specific embodiments of the disclosure, wherein.

DETAILED DESCRIPTION

Figures 1A, 1B, 1C:
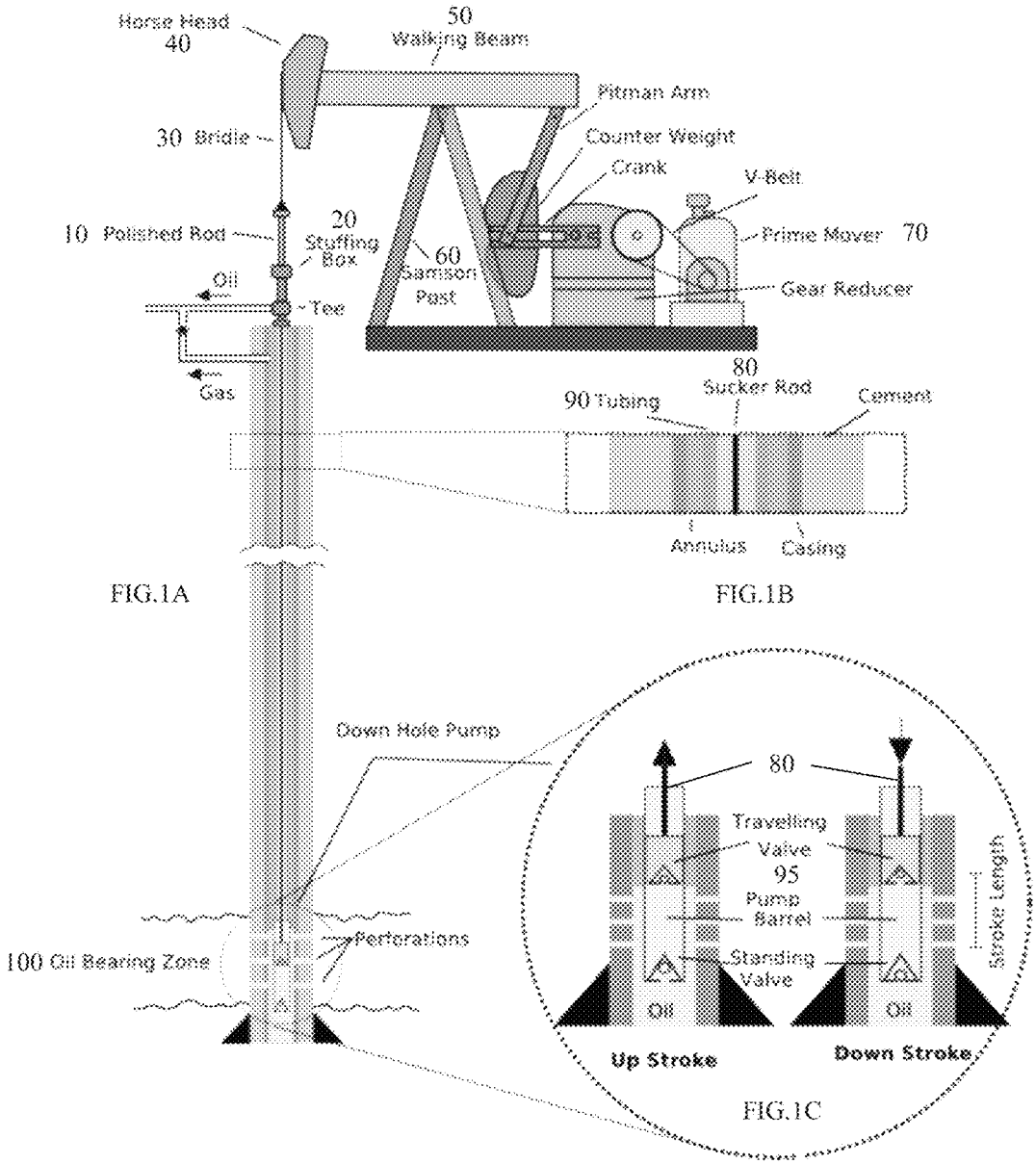
FIGS. 1A-1C (Prior Art)
FIGS. 1A-1D are an illustrative embodiment of a sucker rod pump and conditions associated with different pump cards.
Figure 1D:
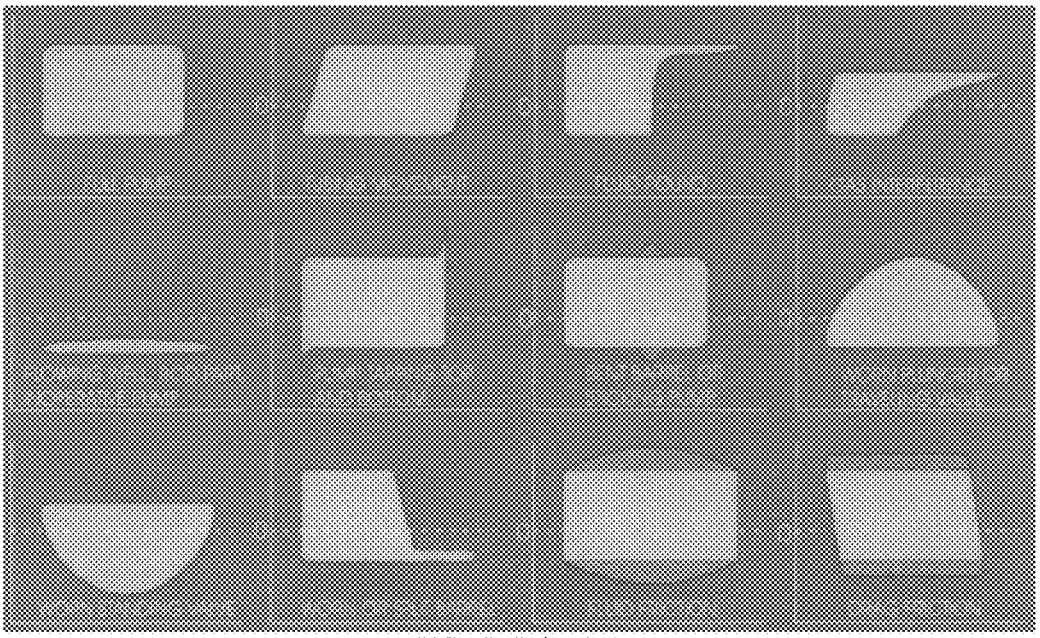
FIG. 1D (Prior Art)

Refer now to the drawings wherein depicted elements are not necessarily shown to scale and wherein like or similar elements are designated by the same reference numeral through the several views.

Referring to the drawings in general, it will be understood that the illustrations are for the purpose of describing particular implementations of the disclosure and are not intended to be limiting thereto. While most of the terms used herein will be recognizable to those of ordinary skill in the art, it should be understood that when not explicitly defined, terms should be interpreted as adopting a meaning presently accepted by those of ordinary skill in the art.

It is to be understood that both the foregoing general description and the following detailed description are exemplary and explanatory only, and are not restrictive of the invention, as claimed. In this application, the use of the singular includes the plural, the word "a" or "an" means "at least one," and the use of "or" means "and/or," unless specifically stated otherwise. Furthermore, the use of the term "including," as well as other derivations such as "includes" and "included," is not limiting. Also, terms such as "element" or "component" encompass both elements or components comprising one unit and elements or components that comprise more than one unit unless specifically stated otherwise.

Systems and methods for monitoring of downhole pump conditions are discussed herein. These systems may allow a user to determine pump or well conditions based on polished rod load, polished rod position, and time data gathered by the system. Based on the shape of a resulting pump dynagraph card, pump and/or well conditions may be diagnosed. The systems and methods also provide real-time monitoring, high accuracy, and low noise when monitoring downhole pump conditions.

A system for monitoring pump conditions may be coupled to any suitable sucker rod pump, such as a non-limiting example shown in FIG. 1A-1C. As shown in FIG. 1A, a sucker rod pump unit may be positioned at the surface to pump fluids from a well below. The sucker rod pump unit may include a polished rod 10 passing through a stuffing box 20. Bridle 30 may couple the polished rod 10 to a horse head 40 of a walking beam 50. Walking beam 50 may move on frame 60 to allow the horse head 40 to move up and down. The walking beam 50 may be coupled to a prime mover 70, which may drive movement of the horse head 40 and walking beam 50, such as through gearing, cranks, counterweights, belts, pulleys, combinations thereof, or the like. As shown in FIG. 1B, the polished rod 10 is coupled to one or more sucker rod(s) 80, which are position in tubing 90. As shown in FIG. 1C, the sucker rod 80 downhole pump to move up and down, thereby creating the pumping action desired to retrieve fluids from an oil bearing zone 100.

As discussed previously, a surface dynagraph card shows changes in the polished rod load versus rod displacement. Utilizing the surface dynagraph card and corresponding pump dynagraph card, various pump and/or well conditions may be diagnosed. In some embodiments, the system may determine desired information (e.g. surface load and position data) utilizing one or more sensors, such as downhole or surface sensors. In some embodiments, the system may determine desired information (e.g. polished rod load and polished rod position data) from motor data parameters relating to computing the downhole dynamometer card without the need for additional sensor(s) and/or equipment. In one embodiment, motor current, motor voltage, and/or other parameters may be used in determining polished rod position and load. As a non-limiting example, methods for determining polished rod position and load are discussed in U.S. Pat. No. 4,490,094, which is incorporated herein by reference.

As discussed herein, "real-time" monitoring refers to systems that allow desired data to be calculated throughout the stroke, instead of waiting for the pumping unit to complete a full stroke to calculate desired data. While some prior sucker rod pump control systems characterized themselves as "real-time" systems, these systems do not actually provide real-time monitoring in the manner discussed herein because these systems do not perform calculations until a full stroke is completed. However, the present systems and methods discussed herein compute the behavior of the downhole pump in real-time throughout the stroke. The wave propagation speed in the rod material is the only delay in the real-time systems and methods discussed herein. In other words, the data is measured in real-time and the calculations are made immediately, yielding a virtually instantaneous solution that is many times faster, with higher accuracy and less noise than the other technology available in the industry today. Some of these other technologies implement the method of finite differences to estimate rod position and load, which can produce noisy results with respect to the behavior of the rod string and pump. This noisiness is primarily due to the fact that the derivatives that are estimated numerically through finite differences can amplify the noise at each step in the solution. By the time one arrives at the pump, the information can be highly unreliable. In the method discussed herein, these derivatives are eliminated. In fact, since integrals are used in the method disclosed herein, the data may actually be somewhat smoothed, possibly removing any undesirable noise in the solution.

Further, in some of these other technologies, the data is measured for the duration of the entire pumping cycle (a stroke of the pumping unit) before any calculations are initiated. Once the pumping unit completes an entire pumping cycle and is beginning the next, it begins computing the downhole card and generating the output. The required data is recorded for an entire pumping cycle, and then, while the pumping unit enters into another cycle, the previously recorded data is entered into an algorithm and the output is calculated. This is a significant drawback in these other technologies since there is significant delay in generating desired information. The systems and methods described herein provide enhancements over these other technologies that wait an entire stroke, including real-time monitoring, high accuracy, and low noise.

The Wave Equation in Sucker Rod Pumping

The model for the physical system that will yield the behavior of the downhole pump which is located at the end of the rod string literally miles away is the nonhomogeneous viscous damped wave equation:

$$\frac{\partial^2 \psi}{\partial t^2} = a^2 \frac{\partial^2 \psi}{\partial x^2} - c\frac{\partial \psi}{\partial t} + g, \tag{1}$$

where $\psi$ is the rod displacement in ft, x is the axial distance along the length of the rod in ft, $\alpha$ is the propagation velocity of the wave in the rod material in ft/sec $$\left(a = \sqrt{\frac{E}{\rho_r}}\right.,$$

where E is the modulus of Elasticity and $\rho_r$ is the density of the rod), c is a semi-empirical damping constant (see U.S. Pat. No. 3,343,409) with dimension $sec^{-1}$ $$\left(c = \frac{k}{A\rho_r}\right.,$$

where k is a friction coefficient and A is the rod cross-sectional area), and g is a gravity term with dimension ft/sec$^2$. The gravity term is separated from (1) and two separate wave equations are formed. The first is a static form of the wave equation and the second is the dynamic solution of the wave equation. These two equations are then solved separately. Using the principle of superposition, their solutions are then combined to yield the total solution. One is a static solution of the wave equation, $\sigma(x)$, while the other is a dynamic form, $\gamma(x; t)$. We can think of the total solution as the sum of the dynamic and static solutions, i.e. $\psi(x,t):=\gamma(x; t)+\sigma(x)$.

For the following derivations, we will consider a rod string with a single diameter from top to bottom. The derivations can easily be generalized to rod strings with multiple tapers.

Separating (1) into static and dynamic parts, the form that only considers the static force of the weight of the rods in fluid is given by $$0 = a^2 \frac{d^2\sigma(x)}{dx^2} + g. \tag{2}$$

The solution to (2) is easily determined.

We are now in a position to solve the remaining dynamic (homogeneous) portion of (1). Since the static portion was separated out by implementing the principle of superposition, the dynamic portion is now a homogeneous wave equation $$\frac{\partial^2\gamma}{\partial t^2} = a^2 \frac{\partial^2\gamma}{\partial x^2} - c\frac{\partial\gamma}{\partial t}. \tag{3}$$

Various prior monitoring methods use measured surface position and load data to compute the behavior of the rod string from the surface down to the pump. In these various methods, a necessary requirement for their solution methods is that the system is in a steady state and is periodic. Thus, the polished rod positions and polished rod loads that are recorded over the entire stroke of the pumping unit serve as the two required boundary conditions needed to obtain a steady state solution to (3).

Figure 2:
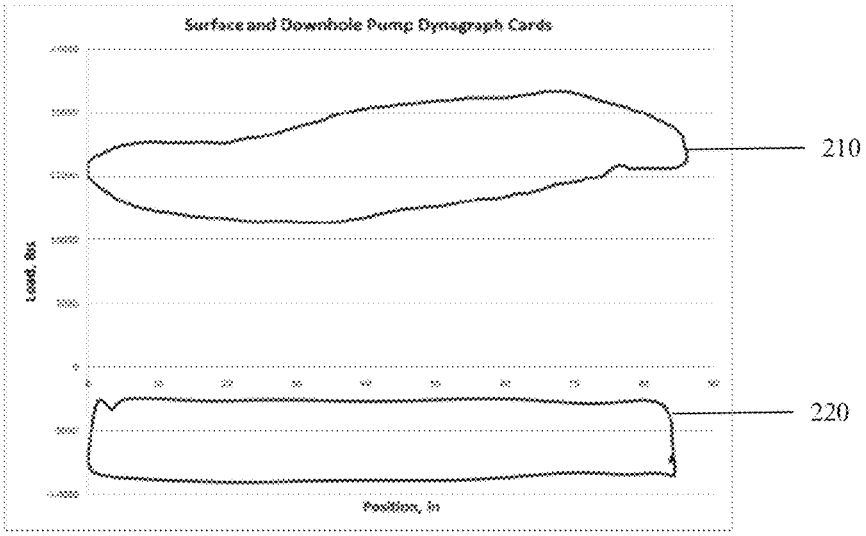
FIG. 2 shows parametric plots of the measured surface loads and positions with the associated parametric plot of the pump loads and positions calculated from the wave equation.
Figures 3A, 3B, 3C, 3D, 3E, 3F, 3G, 3H, 3I, 3J, 3K, 3L:
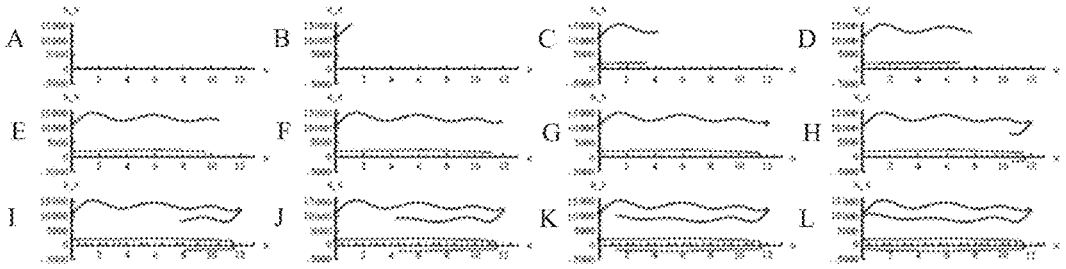
FIGS. 3A-3L show a sequence of the evolution of the surface dynagraph and the associated downhole dynagraph computed in real-time.

The method disclosed herein is not bound by this requirement. In this method, the pump behavior can be observed either in real-time or virtually instantaneously, where the only delay is in the wave propagating along the sucker rod string to the surface. In contrast to other monitoring methods, collecting an entire surface stroke's worth of data in order to begin calculating the conditions at the pump is no longer necessary. FIG. 2 shows parametric plots of the measured surface loads and positions (surface dynagraph card—top 210) with the associated parametric plot of the pump loads and positions calculated from the wave equation (downhole pump dynagraph card—bottom 220). As discussed previously, this pump dynagraph card can be utilized to diagnose various pump and/or well conditions.

As a nonlimiting example, the position and load at the pump may be desired to determine if the pump is filling or if it has "pumped off" for the time being. The term "pumped off" means that the pump is not filling completely, which is most commonly due to the temporarily over displacing the reservoir's inflow into the wellbore. At this point the pumping unit should be stopped to allow the reservoir to catch up and fill the well bore with fluid. Pumping without fluid in the pump barrel can cause extreme damage to the pump, the rod string, the surface unit and gearbox, thereby making information delays on such a "pump off" condition very dangerous for the pumping unit system. Thus, monitoring systems and methods that calculate the real-time behavior of the pump are extremely valuable pieces of equipment to have at the wellsite so the power to the pumping unit can be shut off the instant the pump is identified to be filling incompletely.

Other methods using the wave equation need the pumping unit going through and completing an entire cycle before the calculation of the pump card can be initiated. This is because the data set must be periodic and must represent an entire stroke of the pumping unit in order for a solution to be calculated. The improved method discussed herein is the only analytic solution where the data set does not need to be periodic. The solution is able to yield the behavior of the entire rod string, including the downhole pump the instant that the wave from that point in the rod string reaches the surface. All other techniques require a given data set to be periodic or periodically extended in order to obtain a solution (e.g. a pump dynagraph card) that describes the behavior of the downhole pump.

The integral-based method discussed herein transforms a dynamic solution $\gamma(x, t)$ of the nonhomogenous viscous damped wave equation into a function of complex frequency. Considering (3), the method formulates a solution using the measured boundary conditions of surface load and surface position which have embedded in them the behavior of the downhole pump. We denote the surface position and surface load as functions of time by $f(t)$ and $F(t)$, respectively. Integrating over all frequencies $\omega$ and time t, the real-time solution for the dynamic portion of (1) is found to be $$\gamma(x, t) = \frac{1}{2\pi}\int_{-\infty}^{\infty} f(\xi)\int_{-\infty}^{\infty}\cos(\kappa x)e^{i\omega(\xi-t)}d\omega\, d\xi + \frac{1}{2\pi}\int_{-\infty}^{\infty} F(\xi)\int_{-\infty}^{\infty}\frac{1}{\kappa}\sin(\kappa x)e^{i\omega(\xi-t)}d\omega\, d\xi \tag{4}$$

$$\text{where } \kappa = \frac{1}{a}\sqrt{(ic+\omega)\omega}.$$

Where i represents an imaginary number and $\omega$ represents frequency. The surface position and load measurements are received in discrete pairs. With a plurality of surface position and load measurement pairs, the position at the bottom of the sucker rod string, at say x=L, is computed by $$\gamma(L, t) = \frac{1}{2\pi}\int_{-\infty}^{\infty} f(\xi)\int_{-\infty}^{\infty}\cos(\kappa L)e^{i\omega(\xi-t)}d\omega\, d\xi + \frac{1}{2\pi}\int_{-\infty}^{\infty} F(\xi)\int_{-\infty}^{\infty}\frac{1}{\kappa}\sin(\kappa L)e^{i\omega(\xi-t)}d\omega\, d\xi. \tag{5}$$

Similarly, the load at the bottom of the sucker rod string at x=L is computed by $$EA\frac{\partial\gamma}{\partial x}(L, t) = \frac{EA}{2\pi}\int_{-\infty}^{\infty} f(\xi)\int_{-\infty}^{\infty}\kappa\sin(\kappa L)e^{i\omega(\xi-t)}d\omega\, d\xi - \frac{EA}{2\pi}\int_{-\infty}^{\infty} F(\xi)\int_{-\infty}^{\infty}\cos(\kappa L)e^{i\omega(\xi-t)}d\omega\, d\xi, \tag{6}$$

where E and A are the Young's modulus and cross-sectional area, respectively, of the sucker rod string. The solution continues to step forward in time, computing the positions and loads at the pump as the new positions and loads at the surface are measured, thus giving the downhole pump dynagraph in virtual real-time, where the only delay is in the data transmission rate of the sucker rod string, which is approximately 16,000 ft/sec for steel sucker rods.

The solution to (3) that is given in (4) makes no assumption that the function $\gamma(x,t)$ is periodic in either space or time. Thus, the solution (4) cannot be determined by a discrete set of frequencies and is applicable to a non-periodic data set of surface load data and position data. Instead, it is determined by summing up particular solutions over a continuous frequency spectrum, which is a key distinction in comparison to other methods. Because this limiting assumption is not made by the methods discussed herein, it is no longer necessary to wait for the pumping unit system to complete a stroke and then begin calculations. Thus, combining the solution to (2) with the dynamic solution (4), the complete real-time solution of the wave equation (1) is obtained. FIGS. 3A-3L illustrates a sequence of the evolution of the surface dynagraph and the associated downhole dynagraph computed in real-time.

As an example, looking at the value of the "real-time" computations from an applied point of view, consider a typical pumping unit system running at 8 SPM on a 5000' well. Each cycle of the pumping unit is thus 7.5 seconds in duration. Using the calculation methods of others, the data points from an entire stroke must be recorded before calculating the load and positions of the pump. The delay in beginning calculations for this particular example is at least 24 times longer than having real-time computations available in the systems and methods discussed herein, which is a significant drawback.

Figure 4:
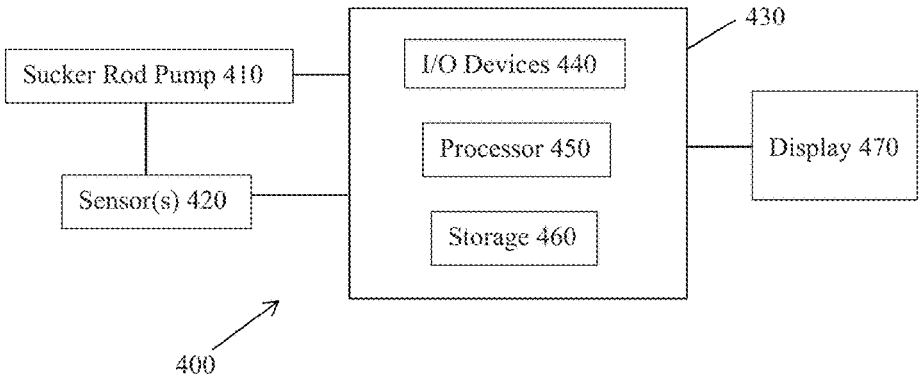
FIG. 4 is an illustrative embodiment of a simplified representation of a rod pump control system

Referring to FIG. 4, which is a simplified representation of a rod pump control system 400, the combination of the solution to equation (2) and the solution in equation (4) together represent the "total solution" to equation (1). This "total solution" is the complete real-time solution of the wave equation (1). The rod pump control system 400 may comprise a sucker rod pump 410 coupled to one or more sensors 420 and a remote terminal unit (RTU) 430. The position and load at the polished rod of pump 410 are measured and recorded by sensor(s) 420. In some embodiments, sensor(s) 420 may include an inclinometer. In some embodiments, sensor(s) 420 may include a load cell. These sensor(s) 420 are coupled to RTU 430 and may provide data from the sensor(s) to the RTU via the I/O devices 440. Utilizing data from the sensor(s), the processing unit 450 may then implements the "total solution" to the wave equation (1) in the manner discussed above to compute the real-time position and load at the downhole pump at the end of the sucker rod string and to provide a downhole card. RTU 430 may provide storage 460, which may be utilized to store software/firmware to implement the "total solution," data gathered by the system, or the like. RTU 430 may provide a display 470 that is utilized to display plots of surface and downhole positions and loads or the downhole card. In some embodiments, display 470 may be part of the RTU 430. In other embodiments, display 470 may be separate from the RTU 430, such as a computer, laptop, or other display. In some embodiments, the RTU 430 may provide the downhole card to display 470 via the internet, wirelessly, or the like. The downhole card can then be used to control the operation of the pump 410 to optimize the operation of the pump.

The following discussion is included to demonstrate particular aspects of the present disclosure. It should be appreciated by those of ordinary skill in the art that the methods described in the examples that follow merely represent illustrative embodiments of the disclosure. Those of ordinary skill in the art should, in light of the present disclosure, appreciate that many changes can be made in the specific embodiments described and still obtain a like or similar result without departing from the spirit and scope of the present disclosure.

Data Input

In a first step of the real-time monitoring of downhole pump conditions, surface (polished rod) load and position data is obtained from the pump. This data will be used in the computation of the downhole dynamometer card from appropriately placed sensors on the pumping unit. As a nonlimiting example, a load cell may be utilized to obtain load data and an inclinometer may be utilized to obtain position data from the pump as discussed previously.

Well and Rod String Constants

In order to compute the downhole pump dynagraph card, it is necessary to obtain well and rod string constants. In some embodiments, the well and rod string constants may be provided to a system by an operator. In some embodiments, a system may be loaded or pre-loaded with information or data that allows the well and rod string constants to be determined. For example, in some embodiments, a user may input constants necessary for computing the downhole pump dynagraph card, such as well and rod string constants, including tubing head pressure, tubing fluid gradient, stuffing box friction, number of rod string tapers, lengths and diameters of each taper, Young's Moduli of each of the rod tapers, damping coefficient, etc. Using the user input, constants can be defined internally for computing the downhole pump dynagraph card. In other embodiments, information related to well and rod string constants may be loaded to the system via an external device (e.g. usb, memory card, etc.) or via a network connection.

Position and Load functions

As noted previously, static load and position can easily be determined from the static part (equation 2) of the nonhomogenous viscous damped wave equation (equation 1). Position and load functions (equations 5 & 6) are used to compute the dynamic load and position of the bottom of the sucker rod string, which is where the pump is located. At this point, the pump position and pump load may computed from the surface (polished rod) load and position that is measured from the surface pumping unit equipment by determining the total solution from the sum of static and dynamic solutions.

This process can easily be extended to rod strings with multiple tapers. The process computing the downhole position and load occurs in real-time. As a nonlimiting example, FIGS. 3A-3L show a sequence of the evolution of the surface dynagraph and the associated downhole dynagraph computed in real-time. The plots progress in real-time as shown in the sequence of figures, and do not require completion of a full stroke before computations and plotting can occur.

Experimental Example

The following examples are included to demonstrate particular aspects of the present disclosure. It should be appreciated by those of ordinary skill in the art that the methods described in the examples that follow merely represent illustrative embodiments of the disclosure. Those of ordinary skill in the art should, in light of the present disclosure, appreciate that many changes can be made in the specific embodiments described and still obtain a similar result without departing from the spirit and scope of the present disclosure.

Comparison of Finite Difference Method v. New Solution Method

Figure 5:
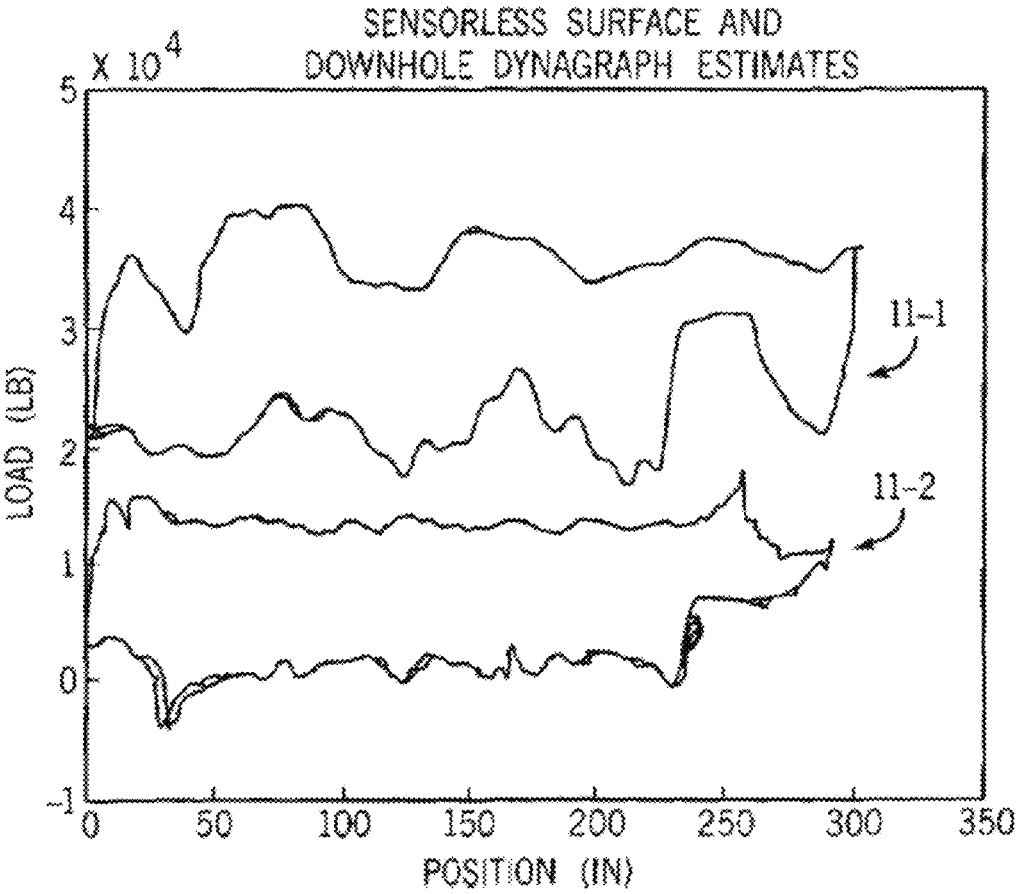
FIG. 5 (Prior Art)
FIG. 5 shows surface and downhole dynagraph cards from a finite difference method illustrating the noise amplification from sensorless measurements and multiple numerical derivatives in the algorithm.
Figure 6:
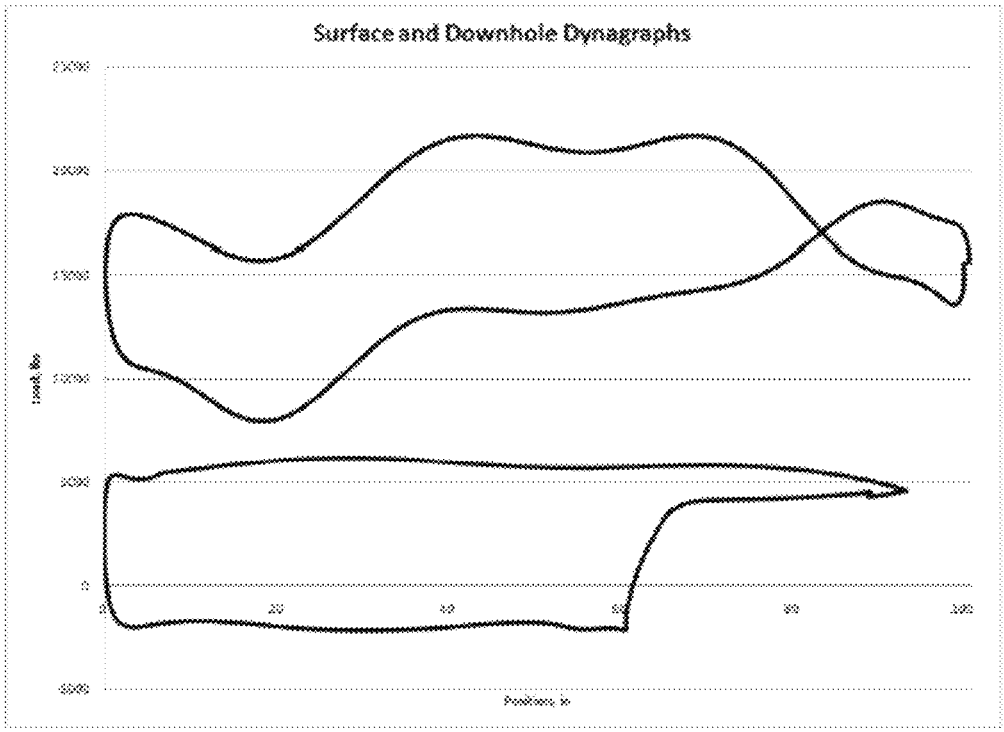
FIG. 6 shows surface and downhole dynagraph cards for the improved method.

The data output from finite difference methods is compared with the results obtained using the complete real-time solution of the wave equation (1) developed in this method. It is well known that numerical differentiation of sampled data amplifies the noise in the data. The poor quality of the downhole pump dynagraph card from using the finite difference method with sensorless load and position data is shown in FIG. 5 (prior art). The new solution method from this disclosure is illustrated in FIG. 6 and shows a much higher quality set of solution data, as evidenced by the well-defined, virtually noiseless pump dynagraph card. Like the prior dynagraph cards, the top portion shows the surface dynagraph, and the bottom portion shows the downhole dynagraph calculated in accordance with the equations discussed above. This results in easier interpretation of well and/or pump conditions for the user, as well as an automated system.

Figure 7:
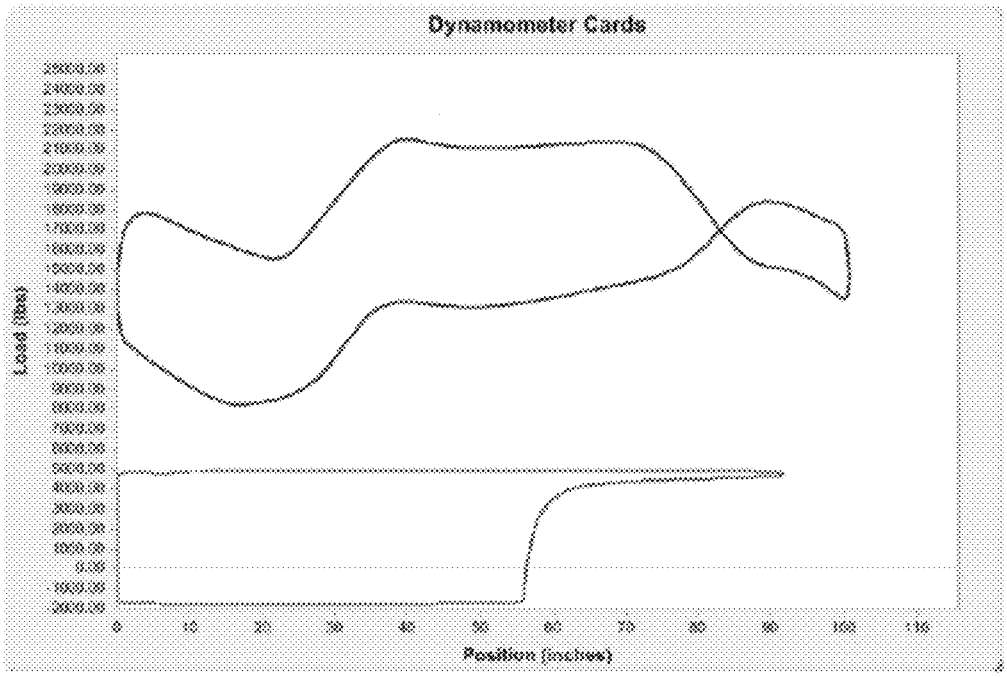
FIG. 7 shows surface and downhole dynagraph cards from a predictive program.

Finally, a demonstration of the ability of the new solution method to reproduce the pump dynagraph card that was created using a predictive program is illustrated. In the predictive program, the various parameters of the pumping unit system are selected, and the system behaviors are then predicted by the software. The surface and pump dynagraph cards of the predictive program are computed in FIG. 7. The surface card data is made available from the program in tabular form. This surface card data is then used as the input data for the new solution method in FIG. 6. The new solution method produces a very precise and accurate, virtually noise free pump dynagraph card that is in excellent agreement with the predicted pump dynagraph card both in stroke length and pump load.

Embodiments described herein are included to demonstrate particular aspects of the present disclosure. It should be appreciated by those of skill in the art that the embodiments described herein merely represent exemplary embodiments of the disclosure. Those of ordinary skill in the art should, in light of the present disclosure, appreciate that many changes can be made in the specific embodiments described and still obtain a similar result without departing from the spirit and scope of the present disclosure. From the foregoing description, one of ordinary skill in the art can easily ascertain the essential characteristics of this disclosure, and without departing from the spirit and scope thereof, can make various changes and modifications to adapt the disclosure to various usages and conditions. The embodiments described herein are meant to be illustrative only and should not be taken as limiting of the scope of the disclosure.

What is claimed is:

1. A method for monitoring downhole pump conditions in real-time, the method comprising:

coupling a load sensor and a position sensor to a rod pump provided at a surface of a well;

gathering surface load data and position data from the load and position sensors of the rod pump;

estimating downhole load and downhole position in real-time throughout a pump stroke utilizing the surface load data, the surface position data, and a nonhomogenous viscous damped wave equation, wherein the downhole load and the downhole position is determined by estimating a static downhole position and a static downhole load utilizing a static solution $\sigma(x)$ of the nonhomogenous viscous damped wave equation, estimating a dynamic downhole load and a dynamic downhole position utilizing a dynamic solution $\gamma(x, t)$ transformed into a function of complex frequency that is integrated over all frequencies ($\omega$) and time (t), and determining a total solution $\psi(x, t)$ from the static and the dynamic solutions, wherein the downhole load is determined from the static downhole load and the dynamic downhole load, and the downhole position is determined from the static downhole position and the static downhole position; and plotting the downhole load and the downhole position in real-time to provide a plot of the downhole position v. the downhole load.

2. The method of claim 1, wherein the dynamic solution $\gamma(x, t)$ of the nonhomogenous viscous damped wave equation is applicable to a non-periodic data set of the surface load data and position data.

3. The method of claim 1, wherein a rod of the rod pump has multiple tapers.

4. The method of claim 1, wherein the estimating step involving the dynamic solution $\gamma(x, t)$ determines the dynamic downhole position L at a time t from $$\gamma(L, t) = \frac{1}{2\pi}\int_{-\infty}^{\infty} f(\xi)\int_{-\infty}^{\infty}\cos(\kappa L)e^{i\omega(\xi-t)}d\omega\, d\xi + \frac{1}{2\pi}\int_{-\infty}^{\infty} F(\xi)\int_{-\infty}^{\infty}\frac{1}{\kappa}\sin(\kappa L)e^{i\omega(\xi-t)}d\omega\, d\xi,$$

where $\omega$ represents frequency, $f(\xi)$ represents the surface position as a function of time, $F(\xi)$ represents the surface load as a function of time, $\kappa$ represents $$\frac{1}{a}\sqrt{(ic+\omega)\omega},$$

$\alpha$ represents the propagation velocity of a wave in a rod material, and c represents a semi-empirical dampening constant; and the dynamic downhole load from $$EA\frac{\partial\gamma}{\partial x}(L, t) = \frac{EA}{2\pi}\int_{-\infty}^{\infty} f(\xi)\int_{-\infty}^{\infty}\kappa\sin(\kappa L)e^{i\omega(\xi-t)}d\omega\, d\xi - \frac{EA}{2\pi}\int_{-\infty}^{\infty} F(\xi)\int_{-\infty}^{\infty}\cos(\kappa L)e^{i\omega(\xi-t)}d\omega\, d\xi,$$

where E represent the Young's modulus of a rod string, and A represent a cross-sectional area of the rod string.

5. The method of claim 1, wherein the estimating step involving the dynamic solution $\gamma(x, t)$ determines the dynamic downhole position L at a time t from $$\gamma(L, t) = \frac{1}{2\pi}\int_{-\infty}^{\infty} f(\xi)\int_{-\infty}^{\infty}\cos(\kappa L)e^{i\omega(\xi-t)}d\omega d\xi + \frac{1}{2\pi}\int_{-\infty}^{\infty} F(\xi)\int_{-\infty}^{\infty}\frac{1}{\kappa}\sin(\kappa L)e^{i\omega(\xi-t)}d\omega d\xi,$$

where ω represents frequency, f(ξ) represents the surface position as a function of time, F(ξ) represents the surface load as a function of time, κ represents $$\frac{1}{a}\sqrt{(ic+\omega)\omega},$$

α represents the propagation velocity of a wave in a rod material, and c represents a semi-empirical dampening constant.

6. The method of claim 1, wherein the estimating step involving the dynamic solution γ(x, t) determines the dynamic downhole load from $$EA\frac{\partial\gamma}{\partial x}(L,t)=\frac{EA}{2\pi}\int_{-\infty}^{\infty}f(\xi)\int_{-\infty}^{\infty}\kappa\sin(\kappa L)e^{i\omega(\xi-t)}d\omega d\xi-\frac{EA}{2\pi}\int_{-\infty}^{\infty}F(\xi)\int_{-\infty}^{\infty}\cos(\kappa L)e^{i\omega(\xi-t)}d\omega d\xi,$$

where E represent the Young's modulus of a rod string, and A represent a cross-sectional area of the rod string.

7. A system for monitoring downhole pump conditions in real-time, the system comprising:

a rod pump providing a horsehead and sucker rod coupled to the horsehead, wherein the rod pump is position at a surface to pump fluids from a well;

a prime mover coupled to the rod pump, wherein the prime mover drives the horsehead;

a position sensor coupled to the rod pump at the surface, wherein the position sensor measures surface position data of the sucker rod;

a load sensor coupled to the rod pump at the surface, wherein the load sensor measures surface load data of the sucker rod;

a processor receiving the surface load and surface position data, wherein the processor estimates downhole position and downhole load in real-time throughout a pump stroke utilizing the surface load data, the surface position data, and a nonhomogenous viscous damped wave equation, and the downhole position and the downhole load are estimated by estimating a static downhole position and a static downhole load utilizing a static solution σ(x) of the nonhomogenous viscous damped wave equation, estimating a dynamic downhole load and a dynamic downhole position utilizing a dynamic solution γ(x, t) transformed into a function of complex frequency that is integrated over all frequencies (ω) and time (t), and determining a total solution ψ(x, t) from the static and the dynamic solutions, wherein a total downhole load is determined from the static downhole load and the dynamic downhole load, and a total downhole position is determined from the static downhole position and the static downhole position; and a display for plotting the downhole load and the downhole position in real-time to provide a plot of the downhole position v. the downhole load.

8. The system of claim 7, wherein the dynamic solution γ(x, t) of the nonhomogenous viscous damped wave equation is applicable to a non-periodic data set of the surface load data and position data.

9. The system of claim 7, wherein the sucker rod of the rod pump has multiple tapers.

10. The system of claim 7, wherein the estimating step involving the dynamic solution γ(x, t) determines the dynamic downhole position L at a time t from $$\gamma(L,t)=\frac{1}{2\pi}\int_{-\infty}^{\infty}f(\xi)\int_{-\infty}^{\infty}\cos(\kappa L)e^{i\omega(\xi-t)}d\omega\,d\xi+\frac{1}{2\pi}\int_{-\infty}^{\infty}F(\xi)\int_{-\infty}^{\infty}\frac{1}{\kappa}\sin(\kappa L)e^{i\omega(\xi-t)}d\omega\,d\xi,$$

where ω represents frequency, f(ξ) represents the surface position as a function of time, F(ξ) represents the surface load as a function of time, κ represents $$\frac{1}{a}\sqrt{(ic+\omega)\omega},$$

α represents the propagation velocity of a wave in a rod material, and c represents a semi-empirical dampening constant; and the dynamic downhole load from $$EA\frac{\partial\gamma}{\partial x}(L,t)=\frac{EA}{2\pi}\int_{-\infty}^{\infty}f(\xi)\int_{-\infty}^{\infty}\kappa\sin(\kappa L)e^{i\omega(\xi-t)}d\omega\,d\xi-\frac{EA}{2\pi}\int_{-\infty}^{\infty}F(\xi)\int_{-\infty}^{\infty}\cos(\kappa L)e^{i\omega(\xi-t)}d\omega\,d\xi,$$

where E represent the Young's modulus of a rod string, and A represent a cross-sectional area of the rod string.

11. The system of claim 7, wherein the estimating step involving the dynamic solution γ(x, t) determines the dynamic downhole position L at a time t from $$\gamma(L,t)=\frac{1}{2\pi}\int_{-\infty}^{\infty}f(\xi)\int_{-\infty}^{\infty}\cos(\kappa L)e^{i\omega(\xi-t)}d\omega d\xi+\frac{1}{2\pi}\int_{-\infty}^{\infty}F(\xi)\int_{-\infty}^{\infty}\frac{1}{\kappa}\sin(\kappa L)e^{i\omega(\xi-t)}d\omega d\xi,$$

where ω represents frequency, f(ξ) represents the surface position as a function of time, F(ξ) represents the surface load as a function of time, κ represents $$\frac{1}{a}\sqrt{(ic+\omega)\omega},$$

α represents the propagation velocity of a wave in a rod material, and c represents a semi-empirical dampening constant.

12. The system of claim 7, wherein the estimating step involving the dynamic solution γ(x, t) determines the dynamic downhole load from $$EA\frac{\partial\gamma}{\partial x}(L,t)=\frac{EA}{2\pi}\int_{-\infty}^{\infty}f(\xi)\int_{-\infty}^{\infty}\kappa\sin(\kappa L)e^{i\omega(\xi-t)}d\omega d\xi-\frac{EA}{2\pi}\int_{-\infty}^{\infty}F(\xi)\int_{-\infty}^{\infty}\cos(\kappa L)e^{i\omega(\xi-t)}d\omega d\xi,$$

where E represent the Young's modulus of a rod string, and
A represent a cross-sectional area of the rod string.

* * * * *